US009325081B2

(12) United States Patent
Wu et al.

(10) Patent No.: US 9,325,081 B2
(45) Date of Patent: Apr. 26, 2016

(54) CABLE CONNECTOR WITH LOW IMPEDANCE

(71) Applicant: FOXCONN INTERCONNECT TECHNOLOGY LIMITED, Grand Cayman (KY)

(72) Inventors: Jerry Wu, Irvine, CA (US); Jun Chen, Kunshan (CN); Xiao Fan, Kunshan (CN); Zhi-Yong Zhou, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 14/677,924

(22) Filed: Apr. 2, 2015

(65) Prior Publication Data

US 2015/0288079 A1 Oct. 8, 2015

(30) Foreign Application Priority Data

Apr. 2, 2014 (CN) ..... 2014 1 0129297

(51) Int. Cl.
*H01R 24/00* (2011.01)
*H01R 4/02* (2006.01)
*H01R 13/436* (2006.01)

(52) U.S. Cl.
CPC ..... *H01R 4/023* (2013.01); *H01R 13/4367* (2013.01); *H01R 4/027* (2013.01); *H01R 4/028* (2013.01)

(58) Field of Classification Search
CPC ..... H01R 4/023; H01R 4/028; H01R 4/027; H01R 13/4367; H01R 27/02; H01R 13/59; H01R 13/6658
USPC ..... 439/676
See application file for complete search history.

(56) References Cited

U.S. PATENT DOCUMENTS

| | | | | |
|---|---|---|---|---|
| 7,559,805 | B1 * | 7/2009 | Yi | H01R 13/6658 439/660 |
| 7,695,318 | B1 | 4/2010 | Wang et al. | |
| 8,011,968 | B2 | 9/2011 | Lai et al. | |
| 8,992,257 | B2 * | 3/2015 | Ii | H01R 13/59 439/607.41 |
| 2005/0014418 | A1 * | 1/2005 | Ji | H01R 4/023 439/660 |
| 2010/0248552 | A1 * | 9/2010 | He | H01R 27/02 439/638 |
| 2013/0196550 | A1 | 8/2013 | Casher et al. | |
| 2015/0050836 | A1 | 2/2015 | Wu et al. | |

FOREIGN PATENT DOCUMENTS

| | | |
|---|---|---|
| CN | 203481460 | 3/2014 |

* cited by examiner

*Primary Examiner* — Jean F Duverne
(74) *Attorney, Agent, or Firm* — Wei Te Chung; Ming Chieh Chang

(57) ABSTRACT

A cable connector for soldering to a cable defining some core wires includes an insulative body, a plurality of terminals, and a spacer. Each terminal includes a soldering portion extending rearwardly out of the insulative body soldering to the core wires. The spacer includes some stalls and a respective receiving slot formed between every two adjacent stalls for receiving the soldering portions. The receiving slot includes a first receiving slot proximal to the insulative body and a second receiving slot distal from the insulative body. The second receiving slot includes a lower receiving space and an upper receiving space with a smaller width. The soldering portion of the terminal includes a first portion received in the lower receiving space and a second portion received in the first receiving slot. The width of the first portion is larger than the width of the second portion to reduce the impedance.

8 Claims, 8 Drawing Sheets

CABLE CONNECTOR WITH LOW IMPEDANCE

BACKGROUND OF THE INVENTION

1. Field of the Invention

The present invention relates to a cable connector, and more particularly to the structure of improving the impedance of the cable connector.

2. Description of Related Arts

China Patent No. 203481460, issued on Mar. 12, 2014, discloses an electrical connector including an insulative body, a number of terminals received in the insulative body, a cable electrically connected to the corresponding terminals, and a spacer assembled to the back end of the insulative body. The cable comprises a number of core wires. Each terminal comprises a soldering portion soldered to a corresponding core wire. The spacer has a plurality of grooves for receiving the soldering portions of the terminals. A T-shaped separator is disposed between every two neighboring grooves, and the soldering portions of the terminals are restrained in corresponding grooves by corresponding separators. The T-shaped separator prevents the soldering portion from moving upwardly. The grooves, however, limit the sizes of the terminals and the core wires, thus resulting in increase of the impedance of the terminals and the core wires. U.S. Pat. No. 7,695,318, issued on Apr. 13, 2010, discloses a plug connector including terminals so received in positioning slots that the terminals are prevented from moving rearwardly.

An improved cable connector is desired to offer advantages over the related art.

SUMMARY OF THE INVENTION

An object of the present invention is to provide a cable connector, and more particularly to a cable connector having a structure for reducing the impedance of the position of the terminals soldered with the cable.

To achieve the above-mentioned object, a cable connector for soldering to a cable defining some core wires includes an insulative body, a plurality of terminals, and a spacer. Each terminal includes a soldering portion extending rearwardly out of the insulative body soldering to the core wires. The spacer includes some stalls and a respective receiving slot formed between every two adjacent stalls for receiving the soldering portions. The receiving slot includes a first receiving slot proximal to the insulative body and a second receiving slot distal from the insulative body. The second receiving slot includes a lower receiving space and an upper receiving space with a smaller width. The soldering portion of the terminal includes a first portion received in the lower receiving space and a second portion received in the first receiving slot. The width of the first portion is larger than the width of the second portion to reduce the impedance.

According to the present invention, the spacer of the cable connector includes the structures of the stalls and the stopping wall. The stalls and the stopping wall limit part of the terminal in the receiving slot to prevent the terminal from moving upwardly or rearwardly. It guarantees the cable connector work effectively. Increasing the width of the terminals and the distance between the stalls to make the terminals can be soldering with the core wires which having larger diameter, and the impedance of the position of the cable and the terminals will reduce.

DETAILED DESCRIPTION OF THE PREFERRED EMBODIMENT

Reference will now be made in detail to some preferred embodiments of the present invention.

Figure 1:
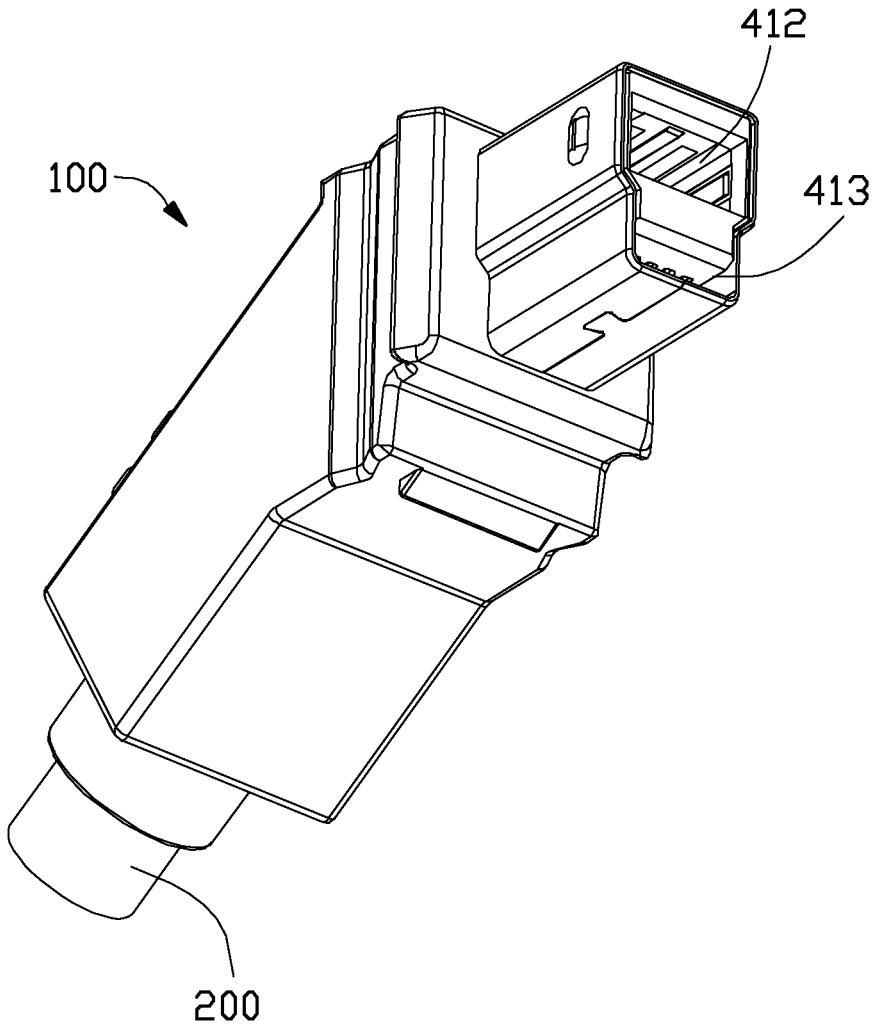
FIG. 1 is a perspective view of a cable connector in accordance with the present invention.
Figure 2:
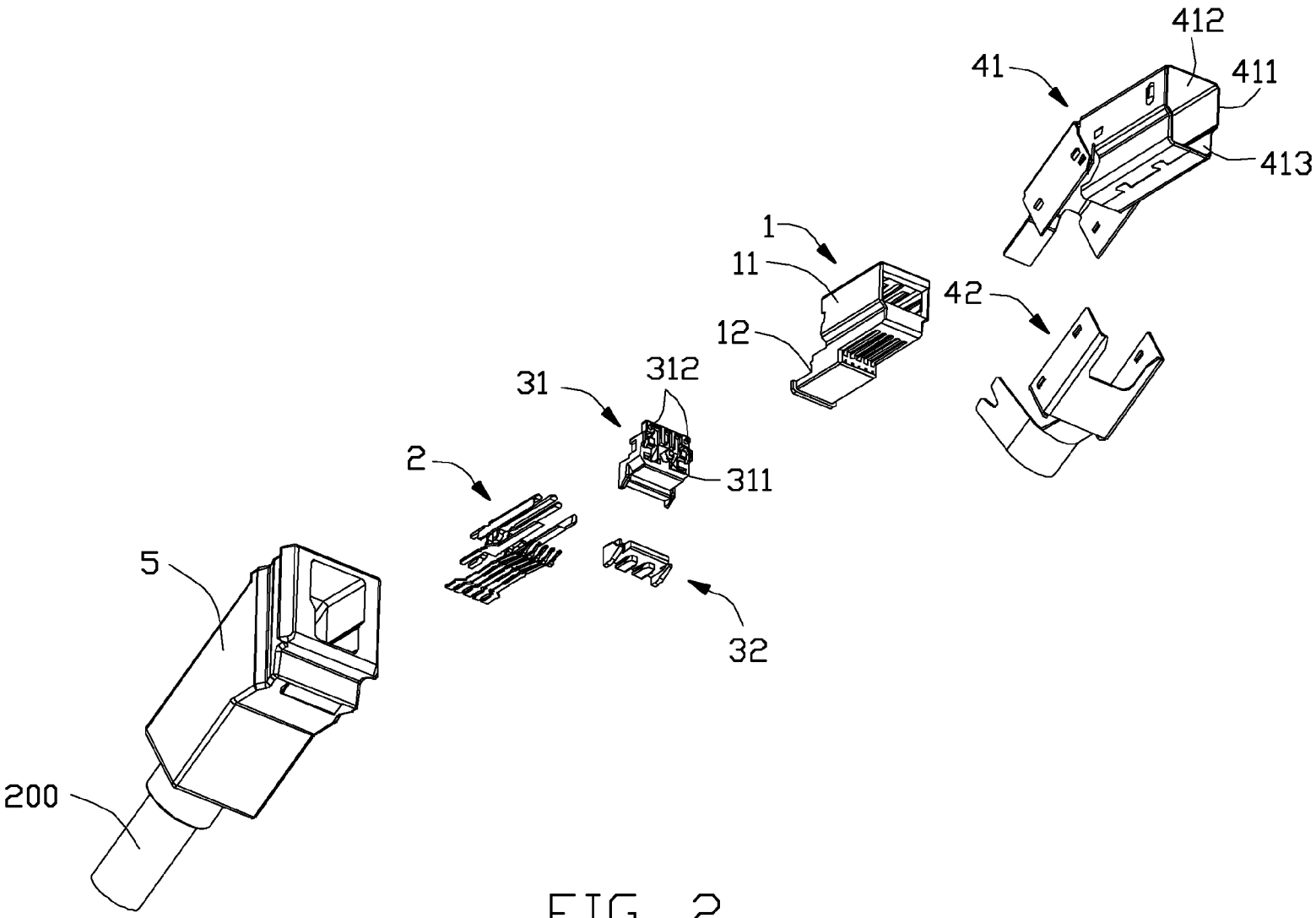
FIG. 2 is an exploded view of the cable connector as shown in FIG. 1.
Figure 3:
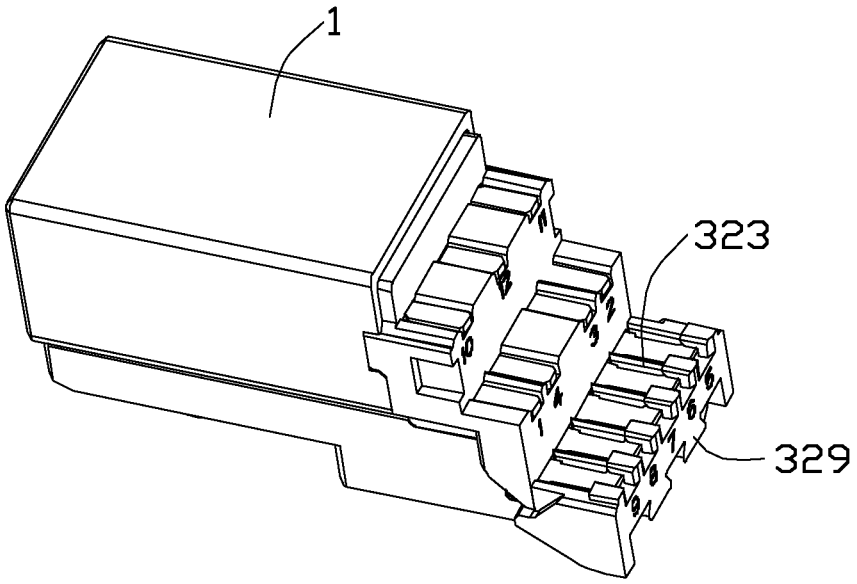
FIG. 3 is a perspective view of the insulative body, the terminals and the spacer of the cable connector as shown in FIG. 1.
Figure 4:
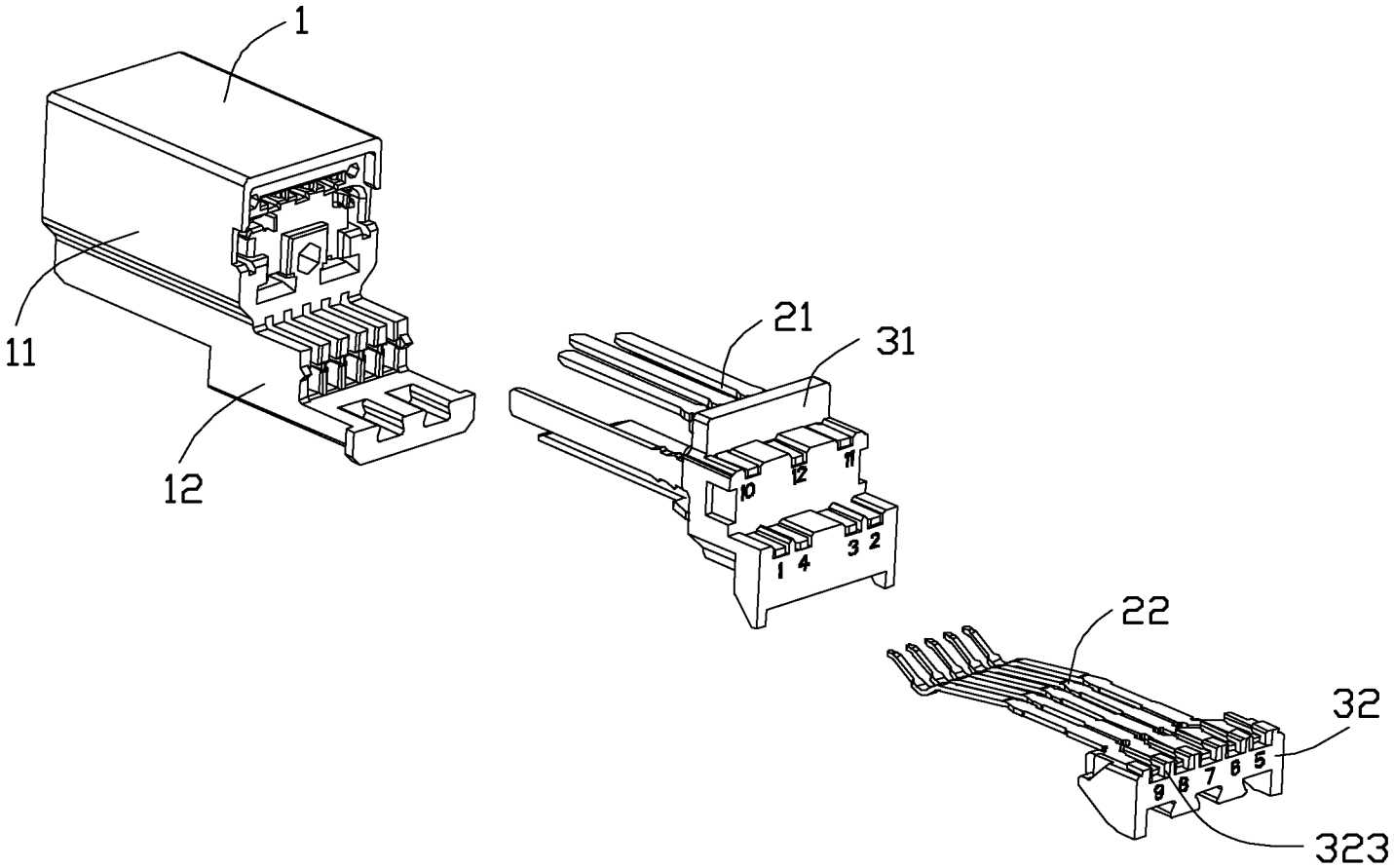
FIG. 4 is a partly exploded view of the insulative body, the terminals and the spacer of the cable connector as shown in FIG. 3.
Figure 5:
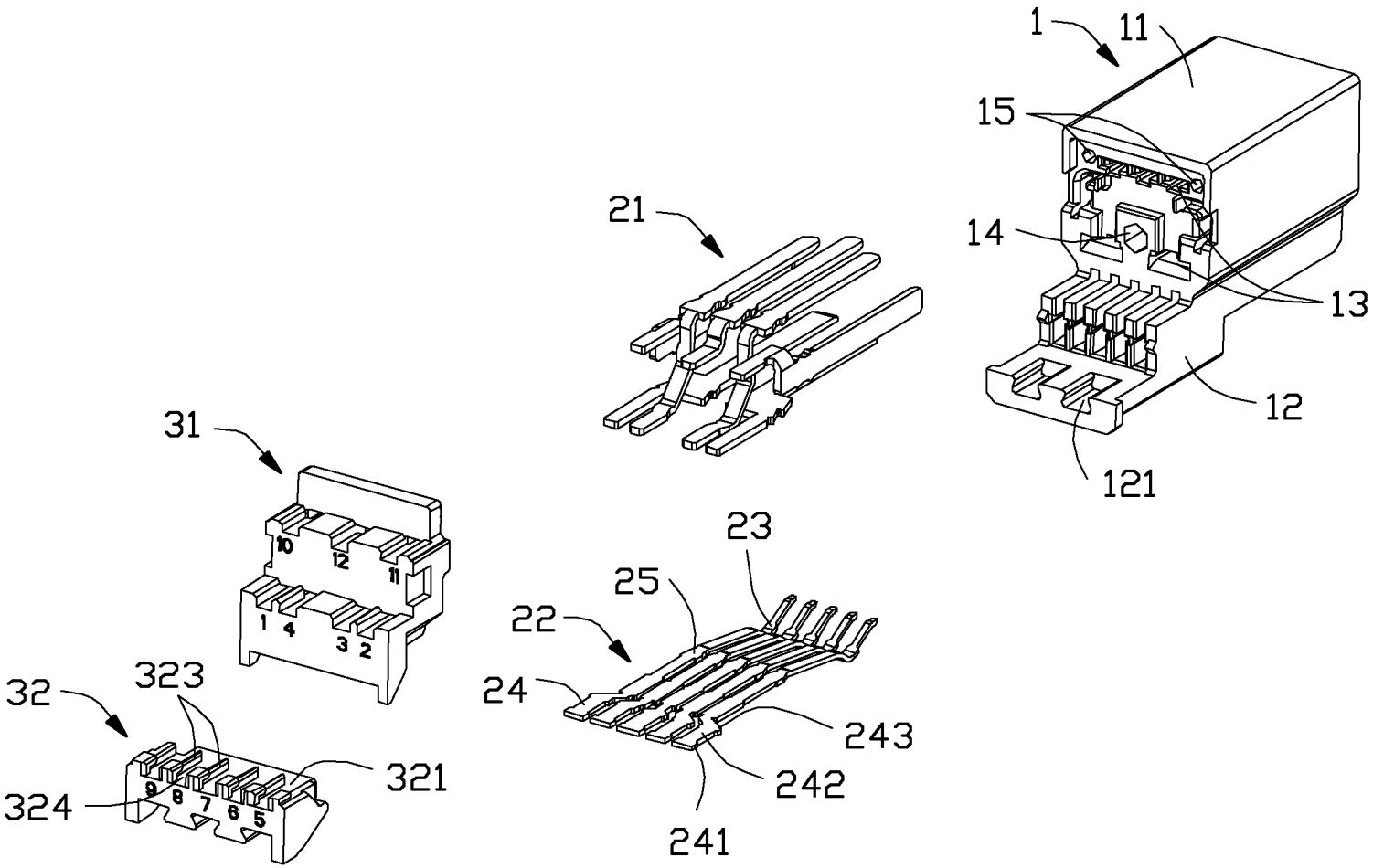
FIG. 5 is an exploded view of the insulative body, the terminals and the spacer of the cable connector as shown in FIG. 3.
Figure 6:
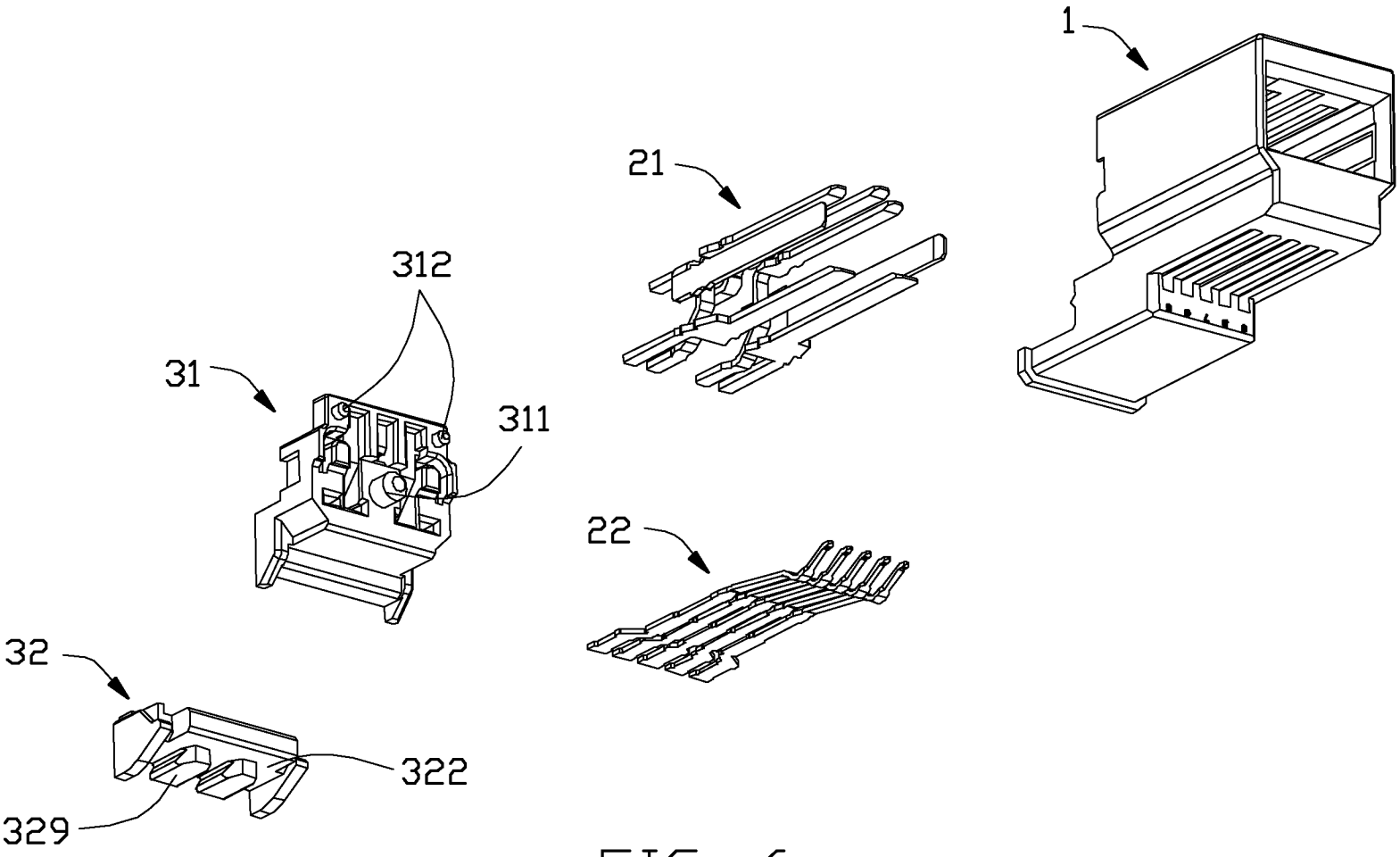
FIG. 6 is another exploded view of the insulative body, the terminals and the spacer of the cable connector as shown in FIG. 5.

Referring to FIGS. 1 to 2, a cable connector 100 for soldering to a cable 200 defining a number of core wires (not shown) comprises an insulative body 1, a plurality of terminals 2 received in the insulative body 1, a spacer 3 mounting behind the insulative body 1, a metal shell 4 enclosing the insulative body 1, and an insulative housing 5 molding to the metal shell 4.

Referring to FIGS. 3 to 6, the insulative body 1 comprises a main portion 11 and a extending portion 12 extending toward the cable 200 from the main portion 11. The extending portion 12 has a shape of ladder. The insulative body 1 comprises a plurality of terminal holes 13 inserted by the terminals 2. The extending portion 12 of the insulative body 1 comprises a fan-shaped slot 121. A face of the insulative body 1 mating with the spacer 3 comprises a first mounting hole 14 and a pair of second mounting holes 15 recessing inwardly. Two sides of the first mounting hole 14 are each disposed a second mounting hole 15. The first mounting hole 14 and the second mounting holes 15 form a triangle to enable the spacer 3 to be mounted on the insulative body 1 more stably.

The terminals 2 comprise a plurality of first terminals 21 and a plurality of second terminals 22. Each second terminal 22 comprises a contacting portion 23 received in the insulative body 1 for contacting with a mating connector (not shown), a soldering portion 24 extending rearwardly out of the insulative body 1 for soldering to the core wires, and a connecting portion 25 connecting the contacting portion 23 and the soldering portion 24. In this embodiment, a width of the soldering portion 24 is increased to be larger than or equal to 0.95 mm. The soldering portion 24 of the second terminal 22 comprises a first portion 241 proximal to the cable 200, a second portion 242 distal from the cable 200, and a third portion 243 extending toward the insulative body 1. The width of the first portion 241 is larger than the width of the second portion 242 to reduce the impedance. The width of the third portion 243 is larger than the width of the second portion 242 so that the third portion 243 can close the terminal hole 13 after the terminal 2 is inserted into the terminal hole 13.

The spacer 3 is mounted on the extending portion 12 of the insulative body 1. The spacer 3 comprises a first spacer 31 and a second spacer 32. The first terminals 21 are held in the first spacer 31 and the second terminals 22 are held in the second spacer 32. The first spacer 31 comprises a first mounting post 311 mating with the first mounting hole 14 and a pair of second mounting posts 312 mating with the second mounting holes 15. The second spacer 3 comprises an upper face 321 and an opposite lower face 322. The upper face 321 projects upwardly to form a plurality of stalls or partitions 323. A receiving slot 324 is formed between adjacent stalls 323. The soldering portions 24 of the second terminals 22 are received in the corresponding receiving slots 324.

Figure 7:
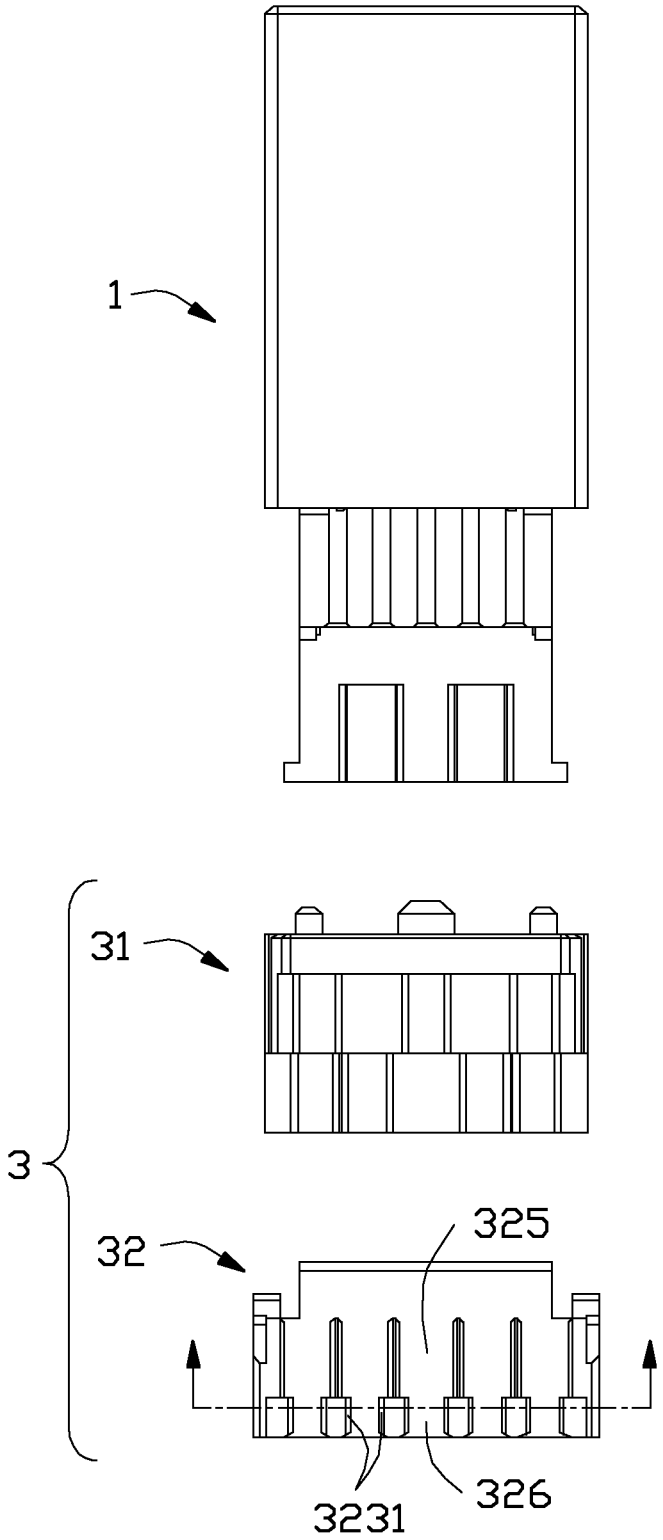
FIG. 7 is a top view of the insulative body and the spacer of the cable connector as shown in FIG. 1.
Figure 8:
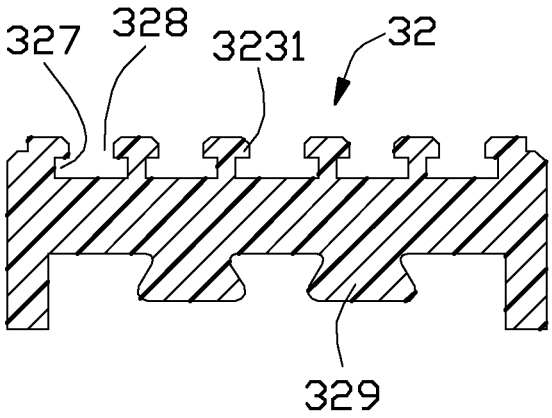
FIG. 8 is a cross-sectional view of the cable connector taken along line 8-8 of FIG. 7.

The receiving slot 324 comprises a first receiving slot 325 proximal to the insulative body 1 and a second receiving slot 326 distal from the insulative body 1. The width of the first receiving slot 325 is larger than or equal to the width of the first portion 241 of the second terminal 22 so that the first portion 241 can be inserted into the second receiving slot 326 from the first receiving slot 325. Referring to FIG. 8, the second receiving slot 326 comprises a lower receiving space 327 and an upper receiving space 328 with a smaller width. The second portion 242 is received in the first receiving slot 325. Referring to FIG. 7, the first portion 241 of the soldering portion 24 is received in the lower receiving space 327 of the second receiving slot 326. The width of the first portion 241 of the soldering portion 24 is larger than the width of the upper receiving space 328, and is smaller than the width of the width of the lower receiving space 327 to prevent the soldering portion 24 from moving upwardly to affect electrical connection of the second terminals 22.

Each portion of the adjacent stalls 323 proximal to the cable 200 comprises a stopping wall 3231 extending toward each other. The stopping wall 3231 limits the first portion 241 of the soldering portion 24 of the second terminals 22 in the lower receiving space 327 of the second receiving slot 326 to prevent the second terminal 22 from moving upwardly. A distance from the stopping wall 3231 to the upper face 321 of the second spacer 32 is larger than the thickness of the second terminal 22.

In this embodiment, the width of the stall 323 is reduced to be smaller than or equal to 0.25 mm so that the width of the first receiving slot 325 can be set larger than or equal to 1.05 mm. Correspondingly, the width of the upper receiving space 328 of the second receiving slot 326 on middle portion is increased to be larger than or equal to 0.8 mm and the width of the upper receiving space 328 of the second receiving slot 326 on other portion is increased to be larger than or equal to 0.65 mm. Due to increasing the width of the receiving slot 324 and the width of the soldering portion 24 of the second terminal 22, the second terminals 22 can be soldered with core wires of larger diameter to reduce the impedance at the junction of the cable 200 and the terminals 22.

The lower face 322 of the second spacer 32 projects outwardly to form a projection 329. The projection 329 is fan-shaped. The projection 329 is inserted and held in the fan-shaped slot 121 to fix the second spacer 32 in the insulative body 1 stably.

The metal shell 4 comprises a first housing 41 and a second housing 42 latching with the first housing 41. The first housing 41 comprises a mating portion 411 extending toward the mating connector. The mating portion 411 comprises a first receiving room 412 and a second receiving room 413 with different widths. The first terminals 21 are partly received in the first receiving room 412, and the second terminals 22 are partly received in the second receiving room 413.

The cable connector 100 is assembled by: inserting the terminals 2 into the insulative body 1; mounting the spacer 3 to the extending portion 12 of the insulative body 1, specifically, the first mounting post 311 of the first spacer 31 being aligned to the first mounting hole 14 of the insulative body 1 and the second mounting posts 312 being aligned to the second mounting hole 15; inserting the second spacer 32, the projection 329 being held in the fan-shaped slot 121; soldering the core wires of the cable 200 to the terminals 2; assembling the metal shell 4 to enclose the insulative body 1; and molding the insulative housing 5 to enclose partly the metal shell 4.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable connector for soldering to a cable defining a plurality of core wires, comprising:

an insulative body;

a plurality of terminals received in the insulative body, each terminal comprising a soldering portion extending rearwardly out of the insulative body for soldering to the core wires; and a spacer mounting behind the insulative body, the spacer comprising a plurality of stalls and a respective receiving slot formed between every two adjacent stalls, the receiving slots receiving the soldering portions; wherein the receiving slot comprises a first receiving slot proximal to the insulative body and a second receiving slot distal from the insulative body, the second receiving slot comprising a lower receiving space and an upper receiving space with a smaller width; and the soldering portion of the terminal comprises a first portion received in the lower receiving space of the second receiving slot and a second portion received in the first receiving slot, the width of the first portion being larger than the width of the second portion to reduce the impedance; wherein the adjacent stalls each comprise a respective stopping wall extending toward each other, the stopping wall preventing the first portion of the soldering portion in the lower receiving space of the second receiving slot from moving upwardly; wherein the width of the second portion of the terminal is smaller than the width of the first portion; wherein the width of the first receiving slot is larger than or equal to the width of the first portion of the terminal to enable insertion of the first portion into the second receiving slot from the first receiving slot.

2. The cable connector as recited in claim 1, wherein the insulative body comprises a plurality of terminal holes receiving the terminals, and the soldering portion of the terminal comprises a third portion extending to the insulative body, the width of the third portion being larger than the width of the second portion to close the terminal hole.

3. The cable connector as recited in claim 1, wherein the spacer comprises an upper face, the stalls projecting outwardly from the upper face of the spacer, a distance from the stopping wall to the upper face being larger than the thickness of the terminal.

4. The cable connector as recited in claim 3, wherein the spacer comprises a first spacer and a second spacer, and the terminals comprise a plurality of first terminals held in the first spacer and a plurality of second terminals held in the second spacer.

5. The cable connector as recited in claim 4, wherein the stalls are disposed on the second spacer.

6. The cable connector as recited in claim 4, wherein the first spacer comprises a first mounting post, and the insulative body comprises a first mounting hole mating with the first mounting post.

7. The cable connector as recited in claim 6, wherein the first spacer comprises a pair of second mounting posts, and the insulative body comprises a pair of second mounting holes mating with the second mounting posts, the three mounting posts forming a triangle.

8. An electrical connector comprising:

an insulative housing defining a plurality of passageways side by side arranged with one another along a transverse direction and each of said passageways extending along a front-to-back direction perpendicular to said transverse direction;

an insulative spacer attached behind the housing and including a plurality of partitions extending along the front-to-back direction with a plurality of receiving slots each between every adjacent two partitions, a rear portion of each of said partitions further including a stopping wall extending toward the neighboring partition with a distance so as to form a first width between the corresponding opposite stopping walls in the transverse direction around a rear end of each receiving slot while a remaining portion of the receiving slot having a second width larger than the first width, the receiving slots corresponding to the passageways with a one-to-one manner while a pitch of the receiving slots being larger than that of the passageways; and a plurality of terminals side by side arranged with one another along said transverse direction, each of said terminals including a front section extending into the corresponding passageway and a rear soldering portion receive within the corresponding receiving slot; wherein the solder portion includes opposite front and rear sections with therebetween in the front-to-back direction a middle section which is adapted to be soldered to a wire, two opposite sides of said rear section being retained by the corresponding stopping walls in both the vertical direction and the front-to-back direction, and a width of the middle section being smaller than those of both the front section and the rear section; wherein two opposite sides of the front section is not restricted by the corresponding partitions in both the vertical direction and the front-to-back direction.

* * * * *